US010905908B2

(12) United States Patent
Sun et al.

(10) Patent No.: US 10,905,908 B2
(45) Date of Patent: Feb. 2, 2021

(54) DOME-BASED CYCLIC INERT SEALING SYSTEM FOR EXTERNAL FLOATING ROOF TANK AND QHSE STORAGE AND TRANSPORT METHOD THEREOF

(71) Applicant: Qiangdan Sun, Beijing (CN)

(72) Inventors: Qiangdan Sun, Beijing (CN); Yuntao Mu, Beijing (CN)

(73) Assignee: Qiangdan Sun, Beijing (CN)

( * ) Notice: Subject to any disclaimer, the term of this patent is extended or adjusted under 35 U.S.C. 154(b) by 201 days.

(21) Appl. No.: 15/885,841

(22) Filed: Feb. 1, 2018

(65) Prior Publication Data

US 2018/0154198 A1 Jun. 7, 2018

(30) Foreign Application Priority Data

Mar. 27, 2017 (CN) ..... 2017 1 0187989

(51) Int. Cl.

| | |
|---|---|
| ***A62C 3/06*** | (2006.01) |
| ***B65D 88/34*** | (2006.01) |
| ***B65D 90/44*** | (2006.01) |
| ***A62C 2/04*** | (2006.01) |
| ***A62C 99/00*** | (2010.01) |
| ***B65D 88/42*** | (2006.01) |
| ***B65D 90/10*** | (2006.01) |
| ***F42D 5/04*** | (2006.01) |
| ***F41H 11/00*** | (2006.01) |

(52) U.S. Cl.

CPC ..... *A62C 3/065* (2013.01); *A62C 2/04* (2013.01); *A62C 99/0018* (2013.01); *B65D 88/34* (2013.01); *B65D 88/42* (2013.01); *B65D 90/44* (2013.01); *B65D 90/10* (2013.01); *B65D 2590/0091* (2013.01); *F41H 11/00* (2013.01); *F42D 5/04* (2013.01)

(58) Field of Classification Search

CPC ..... A62C 2/04; A62C 3/065; A62C 99/0018; B65D 88/34; B65D 88/42; B65D 90/10; B65D 90/44; F41H 11/00

USPC ..... 220/216–227; 169/11, 16, 66; 96/244

See application file for complete search history.

(56) References Cited

U.S. PATENT DOCUMENTS

| | | | | |
|---|---|---|---|---|
| 3,687,329 A * | 8/1972 | Baum | ..... | A62C 3/06 220/216 |
| 4,893,681 A * | 1/1990 | Flandre | ..... | A62C 3/06 169/14 |
| 5,330,009 A * | 7/1994 | Zhang | ..... | A62C 3/06 169/26 |

(Continued)

*Primary Examiner* — Darren W Gorman

(57) ABSTRACT

A dome-based cyclic inert sealing system for an external floating roof tank includes the external floating roof tank, a dome structure, an inert sealing pipeline, and a gas source servo device; wherein the dome structure is formed by a top portion of a tank wall of the external floating roof tank for sealing; the dome structure together with an internal wall of the external floating roof tank, a floating plate and a sealing device form a gas phase space which is isolated from atmosphere, so as to fill the gas phase space with an inert sealing medium; the inert sealing medium is a gas fire-fighting medium used in a suffocation fire-fighting method; the gas source servo device is connected to the gas phase space through the inert sealing pipeline and communicates through a valve for feedback-controlling states of the inert sealing medium in the gas phase space.

9 Claims, 1 Drawing Sheet

(56) References Cited

U.S. PATENT DOCUMENTS

| | | | | |
|---|---|---|---|---|
| 5,377,765 | A * | 1/1995 | Kaylor | A62C 3/06 169/15 |
| 6,237,694 | B1 * | 5/2001 | Chan | A62C 3/06 169/43 |
| 7,124,906 | B2 * | 10/2006 | Hamer | B65D 88/34 220/224 |
| 8,336,637 | B2 * | 12/2012 | Alsaffar | A62C 3/065 169/16 |
| 2004/0194848 | A1 * | 10/2004 | Sauer | A62C 3/08 141/82 |
| 2007/0119605 | A1 * | 5/2007 | Williams | A62C 3/065 169/68 |
| 2012/0312564 | A1 * | 12/2012 | Seliverstov | A62C 3/065 169/46 |
| 2013/0020319 | A1 * | 1/2013 | Riordan | B65D 90/42 220/88.1 |
| 2017/0028235 | A1 * | 2/2017 | Basseches | A62C 35/10 |
| 2017/0136274 | A1 * | 5/2017 | Szocs | A62C 35/13 |

* cited by examiner

DOME-BASED CYCLIC INERT SEALING SYSTEM FOR EXTERNAL FLOATING ROOF TANK AND QHSE STORAGE AND TRANSPORT METHOD THEREOF

CROSS REFERENCE OF RELATED APPLICATION

The present invention claims priority under 35 U.S.C. 119(a-d) to CN 201710187989.5, filed Mar. 27, 2017.

BACKGROUND OF THE PRESENT INVENTION

Field of Invention

The present invention relates to a technical field of storage and transportation of bulk liquid hazardous chemicals, relating to a technical field of safety and environmental protection of external floating roof tanks, and more particularly to a dome-based cyclic inert sealing system for an external floating roof tank and a quality-healthy-safety-environmental (QHSE for short) storage and transport method thereof.

Description of Related Arts

Materials with strategic resource attributes, such as petroleum and their products, are both a support for national strength and a component for combat power. As such materials and their storage and transportation methods, engineering facilities and technical equipment are common to both military and civilians, it is inevitable that they will become the focus of strategic interests and the key tactical attack and defense targets in the military struggle. However, under the background of the contemporary attack force, where series charge-type bullets are commonly used and frequently encountered with actual combat and normal deterrence, the former warhead portion penetrates and drills a hole while a latter warhead portion enters and detonates the container, thus devastating the petroleum gas and detonating materials, resulting in significant after-effects in the overall chemical explosions attack and destruction with high cost-effectiveness ratio. They are the basic mode, necessities and optimal tactics for smashing important military and economic targets such as military fuel supply projects, national strategic reserves and chemical industry parks, etc. Therefore, the conventional self-defense technology for military fuel supply projects is limited to hidden engineering and fire protection technologies of the underground storage tanks, and the conventional external floating roof tanks cannot be applied to the military fuel supply project, so response for detonation mode attack inside the external floating roof tanks is critical for indispensable defense capability.

In addition, it is well-known that bulk liquid hazardous chemicals, both volatile organic compounds (VOCs) resulting from interphase mass transfer, are not only well-known precursor pollutants, carcinogens, haze contributors and greenhouse effect contributors, but also government control objectives related to public safety, life and health, environmental protection, cleaner production, product quality and energy-saving. However, the different categories of prior art related to bulk liquid hazardous chemical containers are often counterproductive due to the process. For example, in the prior art, technical measures to construct a dome in an open area have become a trend due to the drawbacks of roof exposure of an external floating roof tank. However, this technical measure, while eliminating the safety risks of escaping petroleum gas at the lightning ignited ring, poses a safety risk of "accumulation of petroleum gas above a floating plate" and still causes air pollution when the petroleum gas is drained and exhausted.

Therefore, technical solutions aimed at normal isolation of the atmosphere, dynamic cyclic inert sealing, no gas emission, and low operating costs are in line with value orientation of technological advances in this field, which are both the necessary paths for the QHSE integration in engineering science degree of exterior floating roof tanks and an inevitable choice for indispensable defense capability.

Conventionally, Chinese patent "Inert Sealer and anti-explosion equipment for hazardous chemicals containers and defending method thereof", patent No. ZL200410169718.3 (filled and granted by the present inventor), provides a cyclic inert sealer for explosion suspension. The patent discloses technical measures of "flooding the gas phase space of a material container with an inert sealing medium" to keep the oxygen content of the petroleum gas above the floating plate less than the burning and explosion limit of the protected material, permanently suppress burning and explosion conditions of hazardous chemicals, and preliminarily respond to the warhead detonation in the container and materials. However, the solution only gives a general realization of the gaseous inert sealing medium source, and does not give an emphasis on the internal structure, process, control requirements and autonomous defense mechanism of the cyclic inert sealing system. As a result, conventional security technology of external floating roof tanks is still limited to emergency fire protection technology, and cannot be used as a military fuel supply project outfit.

In order to remedy the deficiencies of the prior art, the present invention provides a dome-based cyclic inert sealing system for an external floating roof tank, which aims at improving the efficiency and performance of an inert sealing medium source and a QHSE storage and transportation method based on the system, so as to form autonomous defense capabilities based on integrated QHSE.

SUMMARY OF THE PRESENT INVENTION

A first object of the present invention is to provide a dome-based cyclic inert sealing system for an external floating roof tank, so as to keep the external floating roof tank isolated from atmosphere.

A second object of the present invention is to provide a dome-based cyclic inert sealing system for an external floating roof tank, so as to feedback-control inert sealing medium states in a gas phase space of the external floating roof tank.

A third object of the present invention is to provide a dome-based cyclic inert sealing system for an external floating roof tank, so as to remove impurity from an inert sealing medium during circulation.

A fourth object of the present invention is to provide a QHSE storage and transport method based on a cyclic inert sealing system, which can be normally used as security equipment to upgrade conventional emergency firefighting technology, can be used as a fundamental solution of environmental protection equipment for air pollution caused by external floating roof tanks, and can effectively solve a contradiction between "safety and ventilation" and "environmental protection and emission limitation", so as to achieve inherent safety with no gas phase emission.

A fifth object of the present invention is to provide a QHSE storage and transport method based on a cyclic inert sealing system, so as to form defense capability against follower warheads detonating in gas phase space and/or materials.

Accordingly, in order to accomplish at least one of the above objects, the present invention provides a dome-based cyclic inert sealing system for an external floating roof tank, comprising: the external floating roof tank, a dome structure, an inert sealing pipeline, and a gas source servo device; wherein the dome structure is formed by a top portion of a tank wall of the external floating roof tank for sealing; the dome structure together with an internal wall of the external floating roof tank, a floating plate and a sealing device form a gas phase space which is isolated from atmosphere, so as to fill the gas phase space with an inert sealing medium; the inert sealing medium is a gas fire-fighting medium used in a suffocation fire-fighting method; the gas source servo device is connected to the gas phase space through the inert sealing pipeline and communicates through a valve for feedback-controlling states of the inert sealing medium in the gas phase space.

Preferably, the gas source servo device comprises a servo constant voltage unit, the servo constant voltage unit comprises an inlet gas compressor, a pneumatic check valve, a gas source container, and an outlet gas valve component, wherein:

the inlet gas compressor is controlled to be started or stopped in a manual mode, a linkage mode and\or an automatic mode, so as to transfer, compress and load the inert sealing medium in the gas phase space into the gas source container, as well as feedback-control a pressure of the inert sealing medium in the gas phase space to be no higher than a preset pressure parameter;

the pneumatic check valve matches a rated outlet pressure of the inlet gas compressor, and is arranged on a pipeline between an outlet side of the inlet gas compressor and the gas source container, so as to cooperate with the gas source container for storing a working gas and saving a pressure potential;

the gas source container matches a rated inlet pressure of the inlet gas compressor and a preset storage volume, so as to provide and store the inert sealing medium which is cyclically inputted into the gas phase space; and the outlet gas valve component is controlled to be opened or closed in an independent mode, an automatic mode, a linkage mode and\or a manual mode, so as to throttle and decompress the inert sealing medium in the gas source container before being released into the gas phase space, as well as feedback-control the pressure of the inert sealing medium in the gas phase space to be no lower than the preset pressure parameter.

Preferably, the gas source servo device has a gas inlet end and a gas outlet end, the gas inlet end is a gas inlet of the inlet gas compressor; the gas outlet end is a gas outlet of the outlet gas valve component; the inert sealing pipeline comprises an inlet gas pipeline and an outlet gas pipeline; the dome structure has a gas outlet hole and a gas inlet hole, the gas outlet hole of the dome structure is connected to the gas inlet end of the gas source servo device through the inlet gas pipeline and communicates through a check valve; the gas outlet end of the gas source servo device is connected to the gas inlet hole of the dome structure through the outlet gas pipeline and communicates through another check valve.

Preferably, the external floating roof tank comprises a floating plate central drainage pipeline whose outside-tank end is connected to and communicates with the gas source servo device through the inert sealing pipeline.

Preferably, the inlet gas compressor further comprises a pressure transmitter which is installed on the inlet gas pipeline and communicates with the inlet gas compressor directly or through a control system, so as to detect a gas pressure variable of the gas phase space and transmit a preset pressure parameter signal for starting and stopping the inlet gas compressor.

Preferably, the servo constant voltage unit further comprises a saturated purification component for condensing, leaching, drawing, diverting, converging and recycling a condensable gas of the inert sealing medium passing through the saturated purification component; the saturated purification component is connected between the pneumatic check valve and the gas source container in series, or is parallel to a pipeline between the pneumatic check valve and the gas source container with a first switch valve set for switching between the saturated purification component and the pipeline.

Preferably, the saturated purification component comprises a pressure-bearing gas-liquid separation device, a first backpressure valve, a purge product diverter valve tube, and a liquid product collection vessel, wherein the pressure-bearing gas-liquid separation device matches the rated outlet pressure of the inlet gas compressor, a bottom of the pressure-bearing gas-liquid separation device is one-way-connected to the liquid product collection vessel through the purge product diverter valve tube and communicates through a liquid valve; the first backpressure valve is arranged in an outlet side pipeline of the pressure-bearing gas-liquid separation device.

Preferably, the servo constant voltage unit further comprises a micro differential pressure purification component for leaching, drawing, diverting, converging and recycling a condensable gas of the inert sealing medium passing through the micro differential pressure purification component under a micro differential pressure; the micro differential pressure purification component is connected to the inlet gas pipeline in series, or is parallel to the inlet gas pipeline with a second switch valve set for switching between the micro differential pressure purification component and the inlet gas pipeline.

Preferably, the micro differential pressure purification component comprises a micro differential pressure gas-liquid separation device, a purge product diverter valve tube, and a liquid product collection vessel, wherein a bottom of the micro differential pressure gas-liquid separation device is one-way-connected to the liquid product collection vessel through the purge product diverter valve tube and communicates through a liquid valve.

Preferably, the servo constant voltage unit further comprises a servo temperature control component which comprises a temperature transmitter, an inert sealing medium cooling device and/or an inert sealing medium heating device; the temperature transmitter is installed in the inert sealing pipeline and communicates with the inlet gas compressor and/or the outlet gas valve component directly or through a control system, so as to detecting a temperature variable of the gas phase space in real time and transmit a preset temperature parameter signal for starting or stopping the inlet gas compressor, or for opening or closing the outlet gas valve component; the inert sealing medium heating device is installed in the outlet gas valve component.

Preferably, the gas source servo device further comprises a gas source purification unit for isolating, diverting and collecting a non-condensing impurity gas of the inert sealing medium passing through the gas source purification unit.

Preferably, the gas source purification unit comprises: a third switch valve set and a non-condensing impurity gas removing unit; the non-condensing impurity gas removing unit is parallel to a pipeline between the pneumatic check valve and the gas source container with the third switch valve set for switching between the non-condensing impurity gas removing unit and the pipeline, so as to remove impurity gas in the inert sealing medium which is non-condensing or difficult to condense in a linkage mode, an automatic mode and/or a manual mode; the impurity gas comprises oxygen.

Preferably, the inlet gas compressor further comprises a preset gas content sensor which is installed on the inert sealing pipeline, and communicates with the inlet gas compressor and the third switch valve directly or through a control system, so as to detect a preset gas content in the gas phase space in real time, and transmit a preset gas content parameter signal for automatically starting or stopping the inlet gas compressor and automatically controlling the third switch valve to switch.

Preferably, the preset gas content sensor is a gas content sensor selected from a group consisting of oxygen, nitrogen, methane and non-methane hydrocarbon sensors.

Preferably, the dome structure comprises a manhole unit; the manhole unit comprises a manhole holder having a through hole, and a manhole lid which matches and seals the through hole; the manhole holder is connected to the dome structure in a sealing form, and a floating escalator is provided between the manhole holder and the floating plate; the manhole lip is openable for workers to move in and out the gas phase space, and is closable after the workers pass through.

Preferably, a manhole cabin is provided above and covers the manhole unit, for the workers to exchange autonomous breathing apparatus and/or store special tools.

Preferably, a separating wall is vertically provided in the manhole cabin, and a sealing door is provided on the manhole cabin; the separating wall and the sealing door divide an inner space of the manhole cabin into a ventilation room and a sealing room; wherein the ventilation room has a door for the workers to enter or exit, and/or has a window for ventilating, so as to exchange the autonomous breathing apparatus of the workers and/or store the special tools; the sealing room is provided above the manhole unit for decrease an oxygen content entering the gas phase space.

Preferably, the dome structure has a hard or soft airtight structure with or without a framework.

Preferably, the airtight structure with the framework comprises supporting frameworks, and an airtight hard material or a tensioned membrane structure installed between the supporting frameworks.

Preferably, the airtight structure without the framework comprises an airtight glue fabric or a soft chemical membrane; a pressure of the inert sealing medium in the gas phase space provides a force for the airtight structure without the framework to support a self weight.

Preferably, the dome structure is an airtight structure capable of generating a Faraday cage lightning protection effect, so as to prevent lightning and electrostatic damages, as well as detonate a wall-breaking warhead when resisting energy-gathered explosive attack.

Preferably, the dome-based cyclic inert sealing system further comprises a solar power system, wherein a battery panel or film of the solar power system is arranged on an external wall of the dome structure and/or an external wall of the external floating roof tank.

Preferably, an explosion buffer container is provided in the inlet gas pipeline and/or the outlet gas pipeline in series, and a flameproof material is installed inside the explosion buffer container.

Preferably, at least two external floating roof tanks are arranged in parallel, and the explosion buffer container comprises an inlet gas explosion buffer container and an outlet gas explosion buffer container; wherein the inlet gas explosion buffer container comprises at least two inlet gas entries and an inlet gas exit for sharing; the outlet gas explosion buffer container comprises an outlet gas entry for sharing and at least two outlet gas exits; wherein a gas outlet hole of the external floating roof tank is connected to and communicates with the inlet gas entries of the inlet gas explosion buffer container through the corresponding inlet gas pipeline, and the inlet gas exit of the inlet gas explosion buffer container shares the inlet gas pipeline for being connected to and communicating with the gas inlet end of the gas source servo device; the gas outlet end of the gas source servo device shares the outlet gas pipeline for being connected to and communicating with the outlet gas entry of the outlet gas explosion buffer container, and the outlet gas exits of the outlet gas explosion buffer container are connected to and communicate with the gas inlet end of the external floating roof tank through the outlet gas pipeline.

Preferably, the inlet gas explosion buffer container further comprises an external gas entry for inputting a purified or to-be-purified inert sealing medium; the outlet gas explosion buffer container further comprises an external gas exit for outputting the purified inert sealing medium.

Preferably, the gas source servo device further comprises a monitoring and warning unit for internally monitoring a working state and externally transmitting a warning signal.

Accordingly, in order to accomplish at least one of the above objects, the present invention also provides a QHSE storage and transport method of a dome-based cyclic inert sealing system, comprising providing serve superior breath, which specifically comprises steps of:

detecting a pressure variable characterizing a gas state of the gas phase space by a gas source servo device in real time; when the pressure variable reaches a first preset pressure threshold because an input material of an external floating roof tank, a floating plate and a sealing device are lifted by a liquid level and a gas phase space gradually reduces, executing a gas collecting program by the gas source servo device for partly transferring, compressing and storing an inert sealing medium in the gas phase space into the gas source servo device, until the gas variable is decreased to be no higher than a second preset pressure threshold within the first preset pressure threshold; and when the pressure variable reaches a third preset pressure threshold within the second preset pressure threshold because the input material of the external floating roof tank, the floating plate and the sealing device are lowered by the liquid level and the gas phase space gradually increases, executing a gas supplying program by the gas source servo device for releasing the inert sealing medium in the gas source servo device into the gas phase space after being throttled and decompressed, until the gas variable is increased to the second preset pressure threshold.

Preferably, the QHSE storage and transport method further comprises providing serve inferior breath, which specifically comprises steps of:

when a pressure of the gas phase space is increased due to environmental temperature changes, and the pressure reaches the first preset pressure threshold, executing the gas collecting program by the gas source servo device for partly transferring, compressing and storing the inert sealing medium in the gas phase space into the gas source servo device, until the gas variable is decreased to be no higher than the second preset pressure threshold within the first preset pressure threshold; and when the pressure of the gas phase space is decreased due to the environmental temperature changes, and the pressure is no higher than the third preset pressure threshold within the second preset pressure threshold, executing the gas supplying program by the gas source servo device for releasing the inert sealing medium in the gas source servo device into the gas phase space after being throttled and decompressed, until the gas variable is increased to the second preset pressure threshold.

Preferably, a dome structure is an airtight structure capable of generating a Faraday cage lightning protection effect, so as to prevent lightning and electrostatic damages, as well as detonate a wall-breaking warhead when resisting energy-gathered explosive attack; wherein detonating the wall-breaking warhead comprises steps of:

when an energy-gathered explosive reaches the dome structure with the Faraday cage lightning protection effect, misleading a guidance device to consider the dome structure as a tank roof, in such a manner that the wall-breaking warhead penetrates, breaks walls and drills holes on the dome structure; when a secondary warhead enters the gas phase space, preventing the secondary warhead from being detonated at an effective or best height of burst, in such a manner that a follower warhead is prevented from penetrating the floating plate and explosion in a material; when the follower warhead is detonated in the gas phase space, protecting the floating plate, so as to protect the external floating roof tank and the material by preventing the energy-gathered explosive from achieving a combat object.

Preferably, the QHSE storage and transport method further comprises generating defense capability, which specifically comprises steps of:

staring the dome-based cyclic inert sealing system, and detecting a gas state variable inside or outside the gas phase space of a material container in real time;

when the follower warhead of the energy-gather explosive is successfully detonated in an inert sealing medium atmosphere in the gas phase space of the external floating roof tank and/or the material, absorbing and consuming explosion energy by the inert sealing medium, and/or further absorbing and consuming the explosion energy by diverting into the gas source servo device through an inert sealing pipeline;

executing a forced cooling program when the gas source servo device is triggered by the explosion energy, wherein an inlet gas compressor is used to transfer, compress and load the inert sealing medium in the gas phase space into a gas source container through an inlet gas pipeline, as well as cool the inert sealing medium;

opening an outlet gas valve component for releasing the inert sealing medium in the gas source container into the gas phase space of the material container after being cooled, throttled and decompressed;

forming forced convective circulation and cooling for the inert sealing medium in the gas phase space by the gas source servo device in a continuous or pulse form, so as to continuously purify the inert sealing medium and reduce a material vapor concentration;

continuously discharging the inert sealing medium from a penetration hole on the dome structure by the gas source servo device, so as to prevent air from entering the gas phase space; and protecting the external floating roof tank and the material by reducing a theoretical probability of overall chemical explosion and/or physical explosion to zero.

With the foregoing structure, the present invention forms the gas phase structure, which is isolated from atmosphere and filled with the inert sealing medium by providing the dome structure at an opening at a wall top of the external floating roof tank, so as to store, supply, clean and purify the inert sealing medium in the gas phase space by the gas source servo device, wherein under the premise of effectively supporting material input, output and static storage, the normalization of the oxygen content in the gas phase space is less than the limit of the burning and explosion of the material to be protected, so as to permanently suppress the achievement of combustion and explosion conditions of the material in the external floating roof tank.

BRIEF DESCRIPTION OF THE DRAWINGS

The drawings described herein are used to provide a further understanding of the present invention and constitute a part of the present application. The schematic embodiments and the descriptions of the present invention are used to explain the present invention, and do not constitute improper limitations to the present invention.

DETAILED DESCRIPTION OF THE PREFERRED EMBODIMENT

Figure 1:
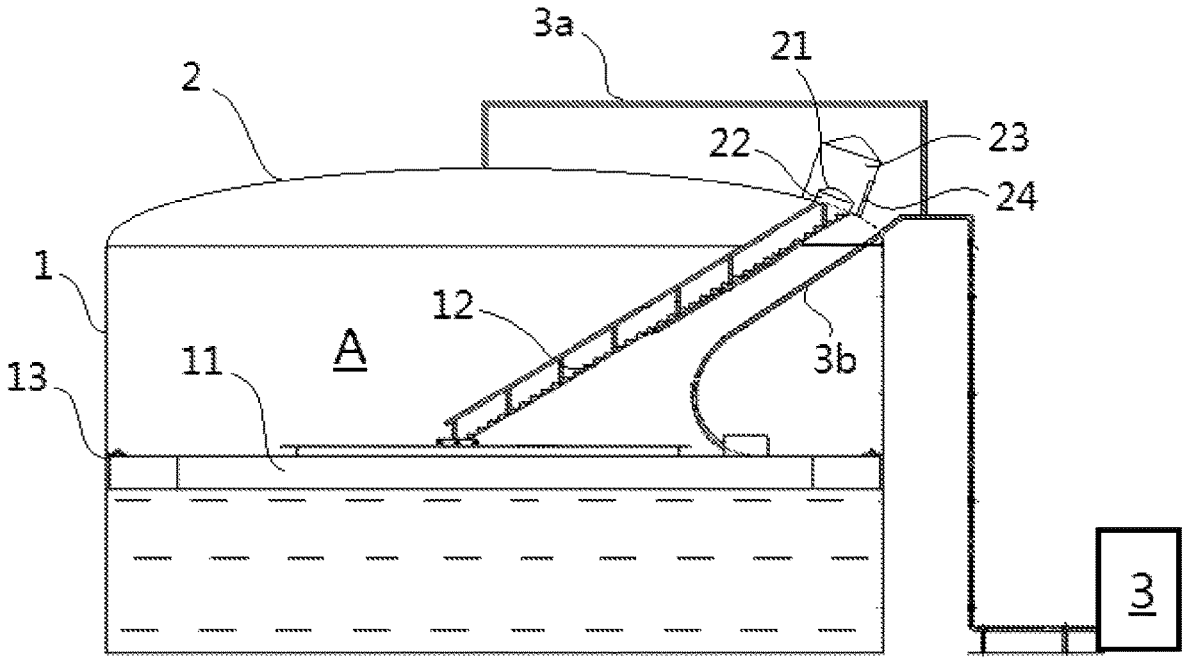
FIG. 1 is a structural view of a dome-based cyclic inert sealing system for an external floating roof tank according to an embodiment of the present invention.

Referring to the drawings, the present invention is further illustrated.

In the present invention, "sealing" refers to the physical isolation from the atmosphere; the concept of "inert sealing" comprises, but is not limited to, the well-known "inert seal filling a system gas phase space with gaseous fire-fighting media," and a permanent non-gas-discharge dynamic inert seal; "inert sealing medium", which is selected according to working conditions, is a gas inert sealing medium commonly used in a suffocation fire-fighting method, especially including nitrogen, carbon dioxide gas, rare gas or engine tail gas; the concept of "cyclic inert sealing" comprises, but is not limited to, the concept of recycling the inert sealing medium for inert sealing, and particularly includes cleaning, purifying and controlling temperature of the gas inert sealing medium by natural circulation or forced circulation.

FIG. 1 is a structural view of a dome-based cyclic inert sealing system for an external floating roof tank according to an embodiment of the present invention. According to the embodiment, the dome-based cyclic inert sealing system for the external floating roof tank comprises: the external floating roof tank 1, a dome structure 2, an inert sealing pipeline, and a gas source servo device 3; wherein the dome structure 2 is formed by a top portion of a tank wall of the external floating roof tank 1 for sealing from atmosphere; the dome structure 2 together with an internal wall of the external floating roof tank 1, a floating plate 11 and a sealing device 13 form a gas phase space A which is isolated from atmosphere, so as to fill the gas phase space A with an inert sealing medium; the gas source servo device 3 is connected to the gas phase space A through the inert sealing pipeline and communicates through a valve for feedback-controlling states (comprising physical and chemical states) of the inert sealing medium in the gas phase space A through storing, supplying or circulating the inert sealing medium.

According to the embodiment, in the external floating roof tank 1, when inputting or outputting materials, the floating plate 11 and the sealing device 13 is lifted or lowered along the internal wall of the external floating roof tank 1, resulting in decrease or increase of a volume of the gas phase space A, which also changes technical parameters of the inert sealing medium. The gas source servo device 3 detects the technical parameters in real time, and starts gas collecting or supplying programs according to preset thresholds, so as to feedback-control the states of the inert sealing medium in the gas phase space A.

During loading and unloading the material of the external floating roof tank 1, the embodiment provides serve superior breath, which specifically comprises steps of: detecting a pressure variable characterizing a gas state of the gas phase space A by a gas source servo device 3 in real time; when the pressure variable reaches a first preset pressure threshold because an input material of an external floating roof tank 1, a floating plate 11 and a sealing device 13 are lifted by a liquid level and a gas phase space A gradually reduces, executing a gas collecting program by the gas source servo device 3 for partly transferring, compressing and storing an inert sealing medium in the gas phase space A into the gas source servo device 3, until the gas variable is decreased to be no higher than a second preset pressure threshold within the first preset pressure threshold; and when the pressure variable reaches a third preset pressure threshold within the second preset pressure threshold because the input material of the external floating roof tank 1, the floating plate 11 and the sealing device 13 are lowered by the liquid level and the gas phase space A gradually increases, executing a gas supplying program by the gas source servo device 3 for releasing the inert sealing medium in the gas source servo device 3 into the gas phase space A after being throttled and decompressed, until the gas variable is increased to the second preset pressure threshold.

When temperatures of the external floating roof tank 1 and environment change, serve inferior breath is provided, which specifically comprises steps of: when a pressure of the gas phase space A is increased due to environmental temperature changes, and the pressure reaches the first preset pressure threshold, executing the gas collecting program by the gas source servo device 3 for partly transferring, compressing and storing the inert sealing medium in the gas phase space A into the gas source servo device 3, until the gas variable is decreased to be no higher than the second preset pressure threshold within the first preset pressure threshold; and when the pressure of the gas phase space A is decreased due to the environmental temperature changes, and the pressure is no higher than the third preset pressure threshold within the second preset pressure threshold, executing the gas supplying program by the gas source servo device 3 for releasing the inert sealing medium in the gas source servo device 3 into the gas phase space A after being throttled and decompressed, until the gas variable is increased to the second preset pressure threshold.

Besides pressure states, the gas source servo device 3 can also processes the inert sealing medium in the gas phase space A according to other technical parameters (such as temperature, oxygen content and methane gas content variables), wherein a process method comprises autonomous circulation and forced circulation. The autonomous circulation refers to that a circulation period of the gas source servo device 3 matches input and output periods of the material during working, so as to store, supply, or circulate the inert sealing medium from the gas phase space A in a plurality of material containers.

The embodiment forms the gas phase structure, which is isolated from atmosphere and filled with the inert sealing medium by providing the dome structure at an opening at a wall top of the external floating roof tank, so as to maintain the states of the inert sealing medium in the gas phase space A by the gas source servo device, wherein under protection of the inert sealing medium, the normalization of the oxygen content in the gas phase space A is less than the limit of the burning and explosion of the material, so as to permanently suppress the achievement of combustion and explosion conditions of the material in the external floating roof tank, and provide normalized response to the warhead explosion in the container. At the same time, the inert sealing medium of the gas phase space A is stored and released through the gas source servo device 3 according to the technical parameters of the gas phase space A, and the inert sealing medium can be circulated in dome-based cyclic inert sealing system for the external floating roof tank 1, which not only saves an amount of the inert sealing medium to be used, but also ensures safety of the external floating roof tank 1 and the materials.

For the external floating roof tank 1 with the dome structure 2 of the present invention, the dome structure 2 can detonate a wall-breaking warhead that is intended to cause an overall chemical explosion, which detonate a follower warhead in the gas phase space A. The gas phase space A is filled with the inert sealing medium, so the materials in the external floating roof tank 1 will not be seriously affected.

Another possible situation is when the external floating roof tank 1 is attacked by a warhead that is designed to cause an overall chemical explosion, the dome structure 2 can induce an end-stage warhead which successfully penetrates the floating plate 11, and a follower warhead is successfully detonated in the material in the external floating roof tank 1. However, the gas phase space A is filled with the inert sealing medium, so this oxygen-free atmosphere can effectively suppress the overall chemical explosion of the material.

In conventional open-top external floating roof tanks, since the rainwater is often accumulated above the floating plates, in order to achieve drainage of the external floating roof tanks, a central drainage pipeline is usually arranged in the floating plates, wherein an outside-tank end of the central drainage pipeline is connected to and communicates with the gas source servo device 3 through the inert sealing pipeline. As a result, arrangement of the inert sealing pipeline can be simplified when updating the conventional external floating roof tanks, so as to reduce cost and difficulty for updating. In the embodiment, the gas source servo device 3 can also be connected to the wall or the external floating roof tank 1 or the dome structure 2 directly through the inert sealing pipeline.

For internal maintenance of the external floating roof tank 1, the dome structure 2 comprises a manhole unit; the manhole unit comprises a manhole holder 22 having a through hole, and a manhole lid 21 which matches and seals the through hole; the manhole holder 22 is connected to the dome structure 2 in a sealing form, and an end of the through hole communicates with the gas phase space A; the manhole lip is openable for workers to move in and out the gas phase space A, and is closable after the workers pass through, so as to ensure a sealing state of the gas phase space A.

For reaching the floating plate 11 easily, a floating escalator 12 is provided between the manhole holder 22 and the floating plate 11 for the workers to enter and exit the gas phase space A and a surface of the floating plate 11.

For keeping the gas phase space A sealed and letting the workers to enter and exit easily, a manhole cabin 23 is provided above and covers the manhole unit, for the workers to exchange autonomous breathing apparatus and/or store special tools. Before entering the gas phase space A, the workers can put on the autonomous breathing apparatus in the manhole cabin 23, and then enter the gas phase space A through the manhole unit; for exiting the gas phase space A, the workers can enter the manhole cabin 23 through the manhole unit, and put off the autonomous breathing apparatus in the manhole cabin 23 before exiting.

A separating wall is vertically provided in the manhole cabin 23, and a sealing door is provided on the manhole cabin 23; the separating wall and the sealing door divide an inner space of the manhole cabin 23 into a ventilation room and a sealing room; wherein the ventilation room has a door 24 for the workers to enter or exit, and/or has a window for ventilating, so as to exchange the autonomous breathing apparatus of the workers and/or store the special tools; the sealing room is provided above the manhole unit for decrease an oxygen content entering the gas phase space A.

Referring to FIG. 1, the dome structure 2 is a key part for forming the gas phase space A, which may adopt various structures, such as an airtight structure with a framework. The airtight structure with the framework is supported and fixed by supporting frameworks, and an airtight portion is installed between the supporting frameworks. For example, the airtight structure with the framework comprises supporting frameworks, and an airtight hard material or a tensioned membrane structure installed between the supporting frameworks. The airtight hard material may be conventional hard boards installed between the supporting frameworks; the tensioned membrane structure is formed between the supporting frameworks by tensioned membrane techniques.

Alternatively, the dome structure 2 may adopt an airtight structure without framework, the airtight structure without the framework comprises an airtight glue fabric or a soft chemical membrane, which is cheaper than the dome structure with the framework; a pressure of the inert sealing medium in the gas phase space A provides a force for the airtight structure without the framework to support a self weight, so as to expand the airtight structure without the framework upwards.

Another form of the dome structure 2 is an airtight structure capable of generating a Faraday cage lightning protection effect, so as to prevent lightning and electrostatic damages, as well as detonate a wall-breaking warhead when resisting energy-gathered explosive attack. Such dome structure 2 can adopt the airtight structure with or without the framework, but material and structure thereof should be able to generate the Faraday cage lightning protection effect.

For the dome structure 2 that produces the Faraday cage lightning protection effect, when the dome structure 2 of the external floating roof tank 1 suffers a warhead attack that is intended to cause an overall chemical explosion, since the dome structure 2 can detonate the wall-breaking warhead and a distance between the dome structure 2 and the floating plate 11 cannot be predicted, a height of burst of a secondary warhead cannot be set, in such a manner that a follower warhead is prevented from penetrating the floating plate 11 and explosion in a material. In addition, the gas phase space A if filled with the inert sealing medium, so the follower warhead cannot ignite and detonate the materials in the oxygen-free atmosphere, prevent overall chemical explosion. When the detonation energy spreads to the atmosphere through the dome structure 2, the Faraday cage effect generated by the dome structure 2 can suppress centrifugal release of detonation energy and reduce a possibility of cloud explosion. The detonation energy then triggers the gas source servo device 3 to start a forced cooling program, wherein an inlet gas compressor 31 is used to transfer, compress and load the inert sealing medium in the gas phase space A into a gas source container 33 through an inlet gas pipeline 3*a*, as well as cool the inert sealing medium, for opening an outlet gas valve component 34 for releasing the inert sealing medium in the gas source container 33 into the gas phase space A of the material container after being cooled, throttled and decompressed, and forming forced convective circulation and cooling for the inert sealing medium in the gas phase space A by the gas source servo device 3 in a continuous or pulse form, so as to continuously purify the inert sealing medium and reduce a material vapor concentration. A gas source purification uses air as a raw material for continuously producing nitrogen gas which is then inputted into the material container through the inert sealing pipeline, so as to prevent air from entering the gas phase space A by continuously discharging the nitrogen gas from a penetration hole on the dome structure 2 by the gas source servo device 3, and finally generate defense capability for resisting explosion of the follower warhead inside the container.

A solar power system may be added to the above dome structure 2, wherein a battery panel or film of the solar power system is arranged on an external wall of the dome structure 2 and/or an external wall of the external floating roof tank 1, so as to save power supply for the dome-based cyclic inert sealing system for the external floating roof tank 1.

Figure 2:
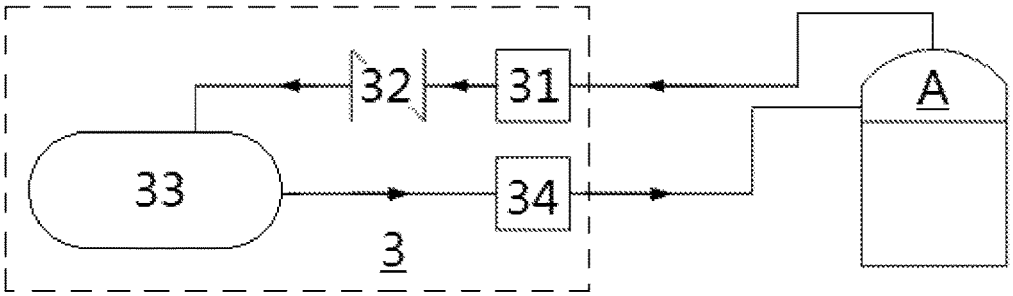
FIG. 2 shows a principle of a gas source servo device of the dome-based cyclic inert sealing system for the external floating roof tank according to the embodiment of the present invention.

FIG. 2 shows a principle of the gas source servo device 3, wherein the gas source servo device 3 comprises a servo constant voltage unit, the servo constant voltage unit comprises an inlet gas compressor 31, a pneumatic check valve 32, a gas source container 33, and an outlet gas valve component 34, wherein the inlet gas compressor 31 is controlled to be started or stopped in a manual mode, a linkage mode and\or an automatic mode, so as to transfer, compress and load the inert sealing medium in the gas phase space A into the gas source container 33, as well as feedback-control a pressure of the inert sealing medium in the gas phase space A to be no higher than a preset pressure parameter.

The pneumatic check valve 32 matches a rated outlet pressure of the inlet gas compressor 31, and is arranged on a pipeline between an outlet side of the inlet gas compressor 31 and the gas source container 33, so as to cooperate with the gas source container 33 for storing a working gas and saving a pressure potential. The gas source container 33 matches a rated inlet pressure of the inlet gas compressor 31 and a preset storage volume, so as to provide and store the inert sealing medium which is cyclically inputted into the gas phase space A The outlet gas valve component 34 is controlled to be opened or closed in an independent mode, an automatic mode, a linkage mode and\or a manual mode, so as to throttle and decompress the inert sealing medium in the gas source container 33 before being released into the gas phase space A, as well as feedback-control the pressure of the inert sealing medium in the gas phase space A to be no lower than the preset pressure parameter.

Referring to FIG. 1, the gas source servo device 3 has a gas inlet end and a gas outlet end, the gas inlet end is a gas inlet of the inlet gas compressor 31; the gas outlet end is a gas outlet of the outlet gas valve component 34; the inert sealing pipeline comprises an inlet gas pipeline 3*a* and an outlet gas pipeline 3*b*; the dome structure 2 has a gas outlet hole and a gas inlet hole, the gas outlet hole of the dome structure 2 is connected to the gas inlet end of the gas source servo device 3 through the inlet gas pipeline 3*a* and communicates through a check valve; the gas outlet end of the gas source servo device 3 is connected to the gas inlet hole of the dome structure 2 through the outlet gas pipeline 3*b* and communicates through another check valve.

The inlet gas compressor 31 is started or stopped according to a technical parameter transmit signal of the inert sealing medium of the gas phase space A. Technical parameters are pressure of the gas phase space A, temperature, preset gas content, etc. The technical parameter transmit signal is sent to the inlet gas compressor through a corresponding transmitter, so as to store exceed inert sealing medium in the gas phase space A by starting or stopping the inlet gas compressor 31. For example, when the pressure of the gas phase space A, the temperature, or an oxygen content is higher than a limit, the inlet gas compressor 31 is started in time to transfer the inert sealing medium from the gas phase space A into the gas source container 33. When the pressure of the gas phase space A, the temperature, and the oxygen content are within preset ranges, the inlet gas compressor 31 is stopped. The outlet gas valve component 34 is able to throttle, decompress and release the inert sealing medium in the gas source container 33 according to the pressure variable of the inert sealing medium of the gas phase space A.

For example, the inlet gas compressor 31 further comprises a pressure transmitter which is installed on the inlet gas pipeline 3*a* and communicates with the inlet gas compressor 31 directly or through a control system, so as to detect a gas pressure variable of the gas phase space A and transmit a preset pressure parameter signal for starting and stopping the inlet gas compressor 31. When the pressure of the gas phase space A is lower than a preset value because of leakage of the inert sealing medium or discharge of a liquid material, the outlet gas valve component 34 is opened by a pressure difference, in such a manner that the inert sealing medium in the gas source container 33 enters the gas phase space A through the outlet gas valve component 34. With the above function of the gas source servo device 3, the gas phase space A of the external floating roof tank 1 uses the inert sealing medium as a balancing working medium for superior and inferior breath without discharging, so as to achieve cyclic protection.

The inert sealing medium from the gas phase space A may comprises condensable and non-condensing impurities which may affect the material stored in the external floating roof tank 1. Therefore, the impurities in the inert sealing medium should be removed. Correspondingly, the servo constant voltage unit further comprises a saturated purification component for condensing, leaching, drawing, diverting, converging and recycling a condensable gas of the inert sealing medium passing through the saturated purification component; the saturated purification component is connected between the pneumatic check valve 32 and the gas source container 33 in series, or is parallel to a pipeline between the pneumatic check valve 32 and the gas source container 33 with a first switch valve set for switching between the saturated purification component and the pipeline.

The saturated purification component comprises a pressure-bearing gas-liquid separation device, a first backpressure valve, a purge product diverter valve tube, and a liquid product collection vessel, wherein the pressure-bearing gas-liquid separation device matches the rated outlet pressure of the inlet gas compressor 31, a bottom of the pressure-bearing gas-liquid separation device is one-way-connected to the liquid product collection vessel through the purge product diverter valve tube and communicates through a liquid valve; the first backpressure valve is arranged in an outlet side pipeline of the pressure-bearing gas-liquid separation device.

Alternatively, the servo constant voltage unit further comprises a micro differential pressure purification component for leaching, drawing, diverting, converging and recycling a condensable gas of the inert sealing medium passing through the micro differential pressure purification component under a micro differential pressure; the micro differential pressure purification component is connected to the inlet gas pipeline 3*a* in series, or is parallel to the inlet gas pipeline 3*a* with a second switch valve set for switching between the micro differential pressure purification component and the inlet gas pipeline 3*a*. The micro differential pressure purification component comprises a micro differential pressure gas-liquid separation device, a purge product diverter valve tube, and a liquid product collection vessel, wherein a bottom of the micro differential pressure gas-liquid separation device is one-way-connected to the liquid product collection vessel through the purge product diverter valve tube and communicates through a liquid valve.

In addition, the dome-based cyclic inert sealing system may further comprise a gas source purification unit for isolating, diverting and collecting a non-condensing impurity gas of the inert sealing medium passing through the gas source purification unit. The gas source purification unit comprises: a third switch valve set and a non-condensing impurity gas removing unit; the non-condensing impurity gas removing unit is parallel to a pipeline between the pneumatic check valve 32 and the gas source container 33 with the third switch valve set for switching between the non-condensing impurity gas removing unit and the pipeline, so as to remove impurity gas in the inert sealing medium which is non-condensing or difficult to condense in a linkage mode, an automatic mode and/or a manual mode; the impurity gas comprises oxygen.

For automatic operation, the inlet gas compressor 31 further comprises a preset gas content sensor which is installed on the inert sealing pipeline, and communicates with the inlet gas compressor 31 and the third switch valve directly or through a control system, so as to detect a preset gas content in the gas phase space A in real time, and transmit a preset gas content parameter signal for automatically starting or stopping the inlet gas compressor 31 and automatically controlling the third switch valve to switch. The preset gas content sensor is a gas content sensor selected from a group consisting of oxygen, nitrogen, methane and non-methane hydrocarbon sensors.

Proper temperature control is a key for storing chemistries, which are very sensitive to temperature, in the external floating roof tank 1. For the dome-based cyclic inert sealing system, the servo constant voltage unit further comprises a servo temperature control component which comprises a temperature transmitter, an inert sealing medium cooling device and/or an inert sealing medium heating device; the temperature transmitter is installed in the inert sealing pipeline and communicates with the inlet gas compressor 31 and/or the outlet gas valve component 34 directly or through a control system, so as to detecting a temperature variable of the gas phase space A in real time and transmit a preset temperature parameter signal for starting or stopping the inlet gas compressor 31, or for opening or closing the outlet gas valve component 34; the inert sealing medium heating device is installed in the outlet gas valve component 34.

In the above embodiment, an explosion buffer container is provided in the inlet gas pipeline 3*a* and/or the outlet gas pipeline 3*b* in series, and a flameproof material is installed inside the explosion buffer container. Preferably, at least two external floating roof tanks 1 are arranged in parallel, and the explosion buffer container comprises an inlet gas explosion buffer container and an outlet gas explosion buffer container; wherein the inlet gas explosion buffer container comprises at least two inlet gas entries and an inlet gas exit for sharing; the outlet gas explosion buffer container comprises an outlet gas entry for sharing and at least two outlet gas exits.

A gas outlet hole of the external floating roof tank 1 is connected to and communicates with the inlet gas entries of the inlet gas explosion buffer container through the corresponding inlet gas pipeline 3*a*, and the inlet gas exit of the inlet gas explosion buffer container shares the inlet gas pipeline 3*a* for being connected to and communicating with the gas inlet end of the gas source servo device 3; the gas outlet end of the gas source servo device 3 shares the outlet gas pipeline 3*b* for being connected to and communicating with the outlet gas entry of the outlet gas explosion buffer container, and the outlet gas exits of the outlet gas explosion buffer container are connected to and communicate with the gas inlet end of the external floating roof tank 1 through the outlet gas pipeline 3*b*. The inlet gas explosion buffer container further comprises an external gas entry for inputting a purified or to-be-purified inert sealing medium; the outlet gas explosion buffer container further comprises an external gas exit for outputting the purified inert sealing medium.

In addition, the gas source servo device 3 of the dome-based cyclic inert sealing system according to the embodiment further comprises a monitoring and warning unit for internally monitoring a working state and externally transmitting a warning signal. The monitoring and warning unit on-line receives the technical parameters characterizing the inert sealing medium of the dome-based cyclic inert sealing system, and is triggered for remotely sending the warning signal when the gas state of the inert sealing medium reaches a technical parameter preset value.

Embodiments of the dome-based cyclic inert sealing system for the external floating roof tank 1 are described as above. A QHSE storage and transport method of the dome-based cyclic inert sealing system will be illustrated as follows, which comprises serve superior breath and/or serve inferior breath.

The serve superior breath specifically comprises steps of: detecting a pressure variable characterizing a gas state of the gas phase space A by a gas source servo device 3 in real time; when the pressure variable reaches a first preset pressure threshold because an input material of an external floating roof tank 1, a floating plate 11 and a sealing device 13 are lifted by a liquid level and a gas phase space A gradually reduces, executing a gas collecting program by the gas source servo device 3 for partly transferring, compressing and storing an inert sealing medium in the gas phase space A into the gas source servo device 3, until the gas variable is decreased to be no higher than a second preset pressure threshold within the first preset pressure threshold; and when the pressure variable reaches a third preset pressure threshold within the second preset pressure threshold because the input material of the external floating roof tank 1, the floating plate 11 and the sealing device 13 are lowered by the liquid level and the gas phase space A gradually increases, executing a gas supplying program by the gas source servo device 3 for releasing the inert sealing medium in the gas source servo device 3 into the gas phase space A after being throttled and decompressed, until the gas variable is increased to the second preset pressure threshold.

The serve inferior breath specifically comprises steps of: when a pressure of the gas phase space A is increased due to environmental temperature changes, and the pressure reaches the first preset pressure threshold, executing the gas collecting program by the gas source servo device 3 for partly transferring, compressing and storing the inert sealing medium in the gas phase space A into the gas source servo device 3, until the gas variable is decreased to be no higher than the second preset pressure threshold within the first preset pressure threshold; and when the pressure of the gas phase space A is decreased due to the environmental temperature changes, and the pressure is no higher than the third preset pressure threshold within the second preset pressure threshold, executing the gas supplying program by the gas source servo device 3 for releasing the inert sealing medium in the gas source servo device 3 into the gas phase space A after being throttled and decompressed, until the gas variable is increased to the second preset pressure threshold.

In the embodiment where the dome structure 2 is the airtight structure capable of generating the Faraday cage lightning protection effect, a corresponding QHSE storage and transport method further comprises detonating the wall-breading warhead and/or generating defense capability; wherein detonating the wall-breaking warhead comprises steps of: when an energy-gathered explosive is near or reaches the dome structure 2, a detonating device detonates the wall-breaking warhead, in such a manner that the wall-breaking warhead penetrates and breaks walls of the dome structure 2; so as to protect the external floating roof tank 1 and the material by preventing the energy-gathered explosive from achieving a combat object.

Generating defense capability specifically comprises steps of:

staring the dome-based cyclic inert sealing system, and detecting a gas state variable inside or outside the gas phase space A of a material container in real time;

when the follower warhead of the energy-gather explosive is successfully detonated in an inert sealing medium atmosphere in the gas phase space A of the external floating roof tank 1 and/or the material, absorbing and consuming explosion energy by the inert sealing medium, and/or further absorbing and consuming the explosion energy by diverting into the gas source servo device 3 through an inert sealing pipeline;

executing a forced cooling program when the gas source servo device 3 is triggered by the explosion energy, wherein an inlet gas compressor 31 is used to transfer, compress and load the inert sealing medium in the gas phase space A into a gas source container 33 through an inlet gas pipeline 3*a*, as well as cool the inert sealing medium;

opening an outlet gas valve component 34 for releasing the inert sealing medium in the gas source container 33 into the gas phase space A of the material container after being cooled, throttled and decompressed;

forming forced convective circulation and cooling for the inert sealing medium in the gas phase space A by the gas source servo device 3 in a continuous or pulse form, so as to continuously purify the inert sealing medium and reduce a material vapor concentration;

continuously discharging the inert sealing medium from a penetration hole on the dome structure 2 by the gas source servo device 3, so as to prevent air from entering the gas phase space A; and protecting the external floating roof tank 1 and the material by reducing a theoretical probability of overall chemical explosion and/or physical explosion to zero.

In the embodiment as shown in FIG. 1, the manhole unit is provided on the dome structure 2. Therefore, the corresponding QHSE storage and transfer method may further comprises displacing oxygen with nitrogen, which specifically comprises steps of:

opening the manhole unit, in such a manner that the gas phase space A of the external floating roof tank 1 communicates with atmosphere;

inputting a material into the external floating roof tank 1;

closing the manhole unit when the floating plate 11 is lifted to a maximum position by material liquid level;

starting the gas source servo device 3;

discharging the material in the external floating roof tank 1, in such a manner that the floating plate 11 is lowered with the material liquid level; and filling the gas phase space A with the inert sealing medium of the gas source servo device 3 through the inert sealing pipeline; and detecting and reading an oxygen content of the gas phase space A until a preset value is reached.

With the saturated purification component and the micro differential pressure purification component described in the above embodiment, the QHSE storage and transfer method may further comprises providing forced purification, wherein when the preset gas content sensor detects that contents of methane and/or non-methane hydrocarbons reach a preset purifying threshold, the gas source servo device 3 starts the gas collecting program and drives the gas supplying program, so as to form forced circulation of the inert sealing medium in the gas phase space A; the inert sealing medium to be purified passes through the micro differential pressure purification component and the saturated purification component for being purified before entering the gas phase space A through the gas supplying program until a preset stopping threshold is detected by the gas content sensor.

With the gas source purification unit described in the above embodiment, the QHSE storage and transfer method may further comprises providing forced purification, wherein when the preset gas content sensor detects that contents of oxygen gas and/or nitrogen gas reach a preset purifying threshold, the gas source servo device 3 starts the gas collecting program and drives the gas supplying program, so as to form forced circulation of the inert sealing medium in the gas phase space A; the inert sealing medium to be purified passes through the micro differential pressure purification component and the saturated purification component for being purified before entering the gas phase space A through the gas supplying program; the gas collecting program and the gas supplying program are stopped when a preset stopping threshold is detected by the gas content sensor.

Finally, it should be noted that the foregoing embodiments are merely intended for describing the technical solutions of the present invention rather than for limiting the technical solutions thereof. Although the present invention is described in detail with reference to the embodiments, persons skilled in the art should understand that the specific embodiments or the processes of the present invention may still be modified or equivalently substituted for part of the technical features. Therefore, any technical solution or process without departing from the spirit of the present invention should be covered by the technical solutions of the present invention.

What is claimed is:

1. A dome-based cyclic inert sealing system for an external floating roof tank, comprising: the external floating roof tank (1), a dome structure (2), an inert sealing pipeline, and a gas source servo device (3); wherein the dome structure (2) is formed by a top portion of a tank wall of the external floating roof tank (1) for sealing; the dome structure (2) together with an internal wall of the external floating roof tank (1), a floating plate (11) and a sealing device (13) form a gas phase space (A) which is isolated from atmosphere, so as to fill the gas phase space (A) with an inert sealing medium; the inert sealing medium is a gas fire-fighting medium used in a suffocation fire-fighting method; the gas source servo device (3) is connected to the gas phase space (A) through the inert sealing pipeline;

wherein the gas source servo device (3) comprises a servo constant voltage unit, the servo constant voltage unit comprises an inlet gas compressor (31) a pneumatic check valve (32), a gas source container (33), and an outlet gas valve component (34), wherein;

the inlet gas compressor (31) is controlled to be started or stopped in a manual mode, a linkage mode and\or an automatic mode, so as to transfer, compress and load the inert sealing medium in the gas phase space (A) into the gas source container (33), as well as feedback-control a pressure of the inert sealing medium in the gas phase space (A) to be no higher than a preset pressure parameter;

the pneumatic check valve (32) matches a rated outlet pressure of the inlet gas compressor (31), and is arranged on a portion of the inert sealing pipeline between an outlet side of the inlet gas compressor (31) and the gas source container (33), so as to cooperate with the gas source container (33) for storing a working gas and saving a pressure potential;

the gas source container (33) matches a rated inlet pressure of the inlet gas compressor (31) and a preset storage volume, so as to provide and store the inert sealing medium which is cyclically inputted into the gas phase space (A); and the outlet gas valve component (34) is controlled to be opened or closed in an independent mode, an automatic mode, a linkage mode and\or a manual mode, so as to throttle and decompress the inert sealing medium in the gas source container (33) before being released into the gas phase space (A), as well as feedback-control the pressure of the inert sealing medium in the was phase space (A) to be no lower than the preset pressure parameter.

2. The dome-based cyclic inert sealing system, as recited in claim 1, wherein the gas source servo device (3) has a gas inlet end and a gas outlet end, the gas inlet end is a gas inlet of the inlet gas compressor (31); the gas outlet end is a gas outlet of the outlet gas valve component (34); the inert sealing pipeline comprises an inlet gas pipeline (3*a*) and an outlet gas pipeline (3*b*); the dome structure (2) has a gas outlet hole and a gas inlet hole, the gas outlet hole of the dome structure (2) is connected to the gas inlet end of the gas source servo device (3) through the inlet gas pipeline (3*a*); the gas outlet end of the gas source servo device (3) is connected to the gas inlet hole of the dome structure (2) through the outlet gas pipeline (3*h*).

3. The dome-based cyclic inert sealing system, as recited in claim 1, wherein the dome structure (2) comprises a manhole unit; the manhole unit comprises a manhole holder (22) having a through hole, and a manhole lid (21) which matches and seals the through hole; the manhole holder (22) is connected to the dome structure (2) in a sealing form, and a floating escalator (12) is provided between the manhole holder (22) and the floating plate (11); the manhole lid (21) is openable for workers to move in and out the gas phase space (A), and is closable after the workers pass through.

4. The dome-based cyclic inert sealing system, as recited in claim 3, wherein a manhole cabin (23) is provided above and covers the manhole unit; for the workers to exchange autonomous breathing apparatus and/or store special tools.

5. The dome-based cyclic inert sealing system, as recited in claim 1, wherein the dome structure (2) is an airtight structure capable of generating a Faraday cage lightning protection effect, so as to prevent lightning and electrostatic damages, as well as detonate a wall-breaking warhead when resisting energy-gathered explosive attack.

6. A QHSE (quality-healthy-safety-environmental) storage and transport method of the dome-based cyclic inert sealing system as recited in claim 1, comprising steps of:

detecting a pressure variable characterizing a gas state of the gas phase space (A) by the gas source servo device (3) in real time; when the pressure variable reaches a first preset pressure threshold because an input material of the external floating roof tank (1), the floating plate (11) and the sealing device (13) are lifted by a liquid level and the gas phase space (A) gradually reduces, executing a gas collecting program by the gas source servo device (3) for partly transferring, compressing and storing an inert sealing medium in the gas phase space (A) into the gas source servo device (3), until the gas variable is decreased to be no higher than a second preset pressure threshold within the first preset pressure threshold; and when the pressure variable reaches a third preset pressure threshold within the second preset pressure threshold because the input material of the external floating roof tank (1), the floating plate (11) and the sealing device (13) are lowered by the liquid level and the gas phase space (A) gradually increases, executing a gas supplying program by the gas source servo device (3) for releasing the inert sealing medium in the gas source servo device (3) into the gas phase space (A) after being throttled and decompressed, until the gas variable is increased to the second preset pressure threshold.

7. The QHSE storage and transport method, as recited in claim 6, further comprising steps of:

when a pressure of the gas phase space (A) is increased due to environmental temperature changes, and the pressure reaches the first preset pressure threshold, executing the gas collecting program by the gas source servo device (3) for partly transferring, compressing and storing the inert sealing medium in the gas phase space (A) into the gas source servo device (3), until the gas variable is decreased to be no higher than the second preset pressure threshold within the first preset pressure threshold; and when the pressure of the gas phase space (A) is decreased due to the environmental temperature changes, and the pressure is no higher than the third preset pressure threshold within the second preset pressure threshold, executing the gas supplying program by the gas source servo device (3) for releasing the inert sealing medium in the gas source servo device (3) into the gas phase space (A) after being throttled and decompressed, until the gas variable is increased to the second preset pressure threshold.

8. The QHSE storage and transport method, as recited in claim 6, wherein the dome structure (2) is an airtight structure capable of generating a Faraday cage lightning protection effect, so as to prevent lightning and electrostatic damages, as well as detonate a wall-breaking warhead when resisting energy-gathered explosive attack; wherein detonating the wall-breaking warhead comprises steps of:

when an energy-gathered explosive reaches the dome structure (2) with the Faraday cage lightning protection effect, misleading a guidance device to consider the dome structure (2) as a tank roof, in such a manner that the wall-breaking warhead penetrates, breaks walls and drills holes on the dome structure (2); when a secondary warhead enters the gas phase space (A), preventing the secondary warhead from being detonated at an effective or best height of burst, in such a manner that a follower warhead is prevented from penetrating the floating plate (11) and explosion in a material; when the follower warhead is detonated in the gas phase space (A), protecting the floating plate (II), so as to protect the external floating roof tank (1) and the material by preventing the energy-gathered explosive from achieving a combat object.

9. The QHSE storage and transport method, as recited in claim 8, further comprising generating defense capability, which specifically comprises steps of:

activating the dome-based cyclic inert sealing system, and detecting a ins state variable inside or outside the gas phase space (A) in real time;

when the follower warhead containing the energy-gathered explosive is successfully detonated in an inert sealing medium atmosphere in the gas phase space (A) of the external floating roof tank (1) and/or the material, absorbing and consuming explosion energy by the inert sealing medium, and/or further absorbing and consuming the explosion energy by diverting into the gas source servo device (3) through the inert sealing pipeline;

executing a forced cooling program when the gas source servo device (3) is triggered by the explosion energy, wherein the inlet gas compressor (31) is used to transfer, compress and load the inert sealing medium in the gas phase space (A) into the gas source container (33) through an inlet gas pipeline (3*a*), as well as cool the inert sealing medium;

opening the outlet gas valve component (34) for releasing the inert sealing medium in the gas source container (33) into the gas phase space (A) after being cooled, throttled and decompressed;

forming forced convective circulation and cooling for the inert sealing medium in the gas phase space (A) by the gas source servo device (3) in a continuous or pulse form, so as to continuously purify the inert sealing medium and reduce a material vapor concentration;

continuously discharging the inert sealing medium from a penetration hole on the dome structure (2) by the gas source servo device (3), so as to prevent air from entering the gas phase space (A); and protecting the external floating roof tank (1) and the material by reducing a theoretical probability of overall chemical explosion and/or physical explosion to zero.

* * * * *